US011433697B2

(12) United States Patent
Ishida

(10) Patent No.: US 11,433,697 B2
(45) Date of Patent: Sep. 6, 2022

(54) CLIP

(71) Applicant: Hirotoshi Ishida, Tokyo (JP)

(72) Inventor: Hirotoshi Ishida, Tokyo (JP)

( * ) Notice: Subject to any disclaimer, the term of this patent is extended or adjusted under 35 U.S.C. 154(b) by 0 days.

(21) Appl. No.: 17/264,851

(22) PCT Filed: Aug. 22, 2019

(86) PCT No.: PCT/JP2019/032764
§ 371 (c)(1),
(2) Date: Feb. 1, 2021

(87) PCT Pub. No.: WO2020/045213
PCT Pub. Date: Mar. 5, 2020

(65) Prior Publication Data

US 2021/0229485 A1 Jul. 29, 2021

(30) Foreign Application Priority Data

Aug. 27, 2018 (JP) ..... JP2018-158417

(51) Int. Cl.
*B42F 1/12* (2006.01)

(52) U.S. Cl.
CPC ..... *B42F 1/12* (2013.01)

(58) Field of Classification Search
CPC ..... B42F 1/12; B42F 1/02; B42F 1/10; B42F 1/08
See application file for complete search history.

(56) References Cited

U.S. PATENT DOCUMENTS 586,003 A * 7/1897 Bennett ..... B42F 1/12 24/67 CF
675,761 A * 6/1901 Vaaler ..... B42F 1/08 24/546

(Continued)

FOREIGN PATENT DOCUMENTS

GB 381095 A * 9/1932 ..... B42F 1/12
JP S565670 U 1/1981

(Continued)

OTHER PUBLICATIONS

International Search Report in PCT/JP2019/032764, dated Oct. 1, 2019. 5pp.

*Primary Examiner* — Robert Sandy
*Assistant Examiner* — Louis A Mercado
(74) *Attorney, Agent, or Firm* — Hauptman Ham, LLP

(57) ABSTRACT

A clip includes an insertion piece insertable into a valley formed by folding a corner of a stack of a plurality of paper pieces, a front-side clamping piece contactable with a paper piece portion on a front side of the valley, and a back-side clamping piece contactable with a paper piece portion on a back side of the valley. The insertion piece, front-side clamping piece, and back-side clamping piece are elastically and integrally formed so that the paper piece portion on the front side and the paper piece portion on the back side of the valley are clamped between the front-side clamping piece and the insertion piece and between the insertion piece and the back-side clamping piece, respectively, and both of the paper piece portion on the front side and the paper piece portion on the back side of the valley are clamped between the front-side and back-side clamping pieces.

2 Claims, 5 Drawing Sheets

(56) References Cited

U.S. PATENT DOCUMENTS

| | | | | | |
|---|---|---|---|---|---|
| 860,856 | A * | 7/1907 | Day | B42F 1/12 | 24/67 CF |
| 1,298,875 | A * | 4/1919 | Brenizer | B42F 1/08 | 24/552 |
| 1,423,520 | A * | 7/1922 | Freedman | B42F 1/12 | 24/67 R |
| 1,637,832 | A * | 8/1927 | Michaela | B42F 3/00 | 24/703.3 |
| 2,460,650 | A * | 2/1949 | Nemeth | B42F 1/12 | 24/67 CF |
| 2,768,416 | A * | 10/1956 | McMullen | B42F 1/02 | 24/67.9 |
| 2,843,901 | A * | 7/1958 | Bukowski | B42F 1/12 | 24/67 CF |
| 4,480,356 | A * | 11/1984 | Martin | B42F 1/02 | 24/545 |
| 5,010,629 | A * | 4/1991 | Hirzel | B42F 1/02 | 24/547 |
| 5,214,825 | A * | 6/1993 | Hirzel | B42F 1/02 | 24/67 R |
| 2009/0151129 | A1 | 6/2009 | Crosson | | |
| 2021/0229485 | A1* | 7/2021 | Ishida | B42F 1/12 | |

FOREIGN PATENT DOCUMENTS

| | | | |
|---|---|---|---|
| JP | S56163565 | U | 12/1981 |
| JP | S62199374 | U | 12/1987 |
| JP | S63170266 | U | 11/1988 |
| JP | H2126886 | U | 10/1990 |
| JP | H479680 | U | 7/1992 |
| JP | H512174 | U | 2/1993 |
| JP | H1035168 | A | 2/1998 |
| JP | 3114399 | U | 10/2005 |
| JP | 201774765 | A | 4/2017 |

* cited by examiner

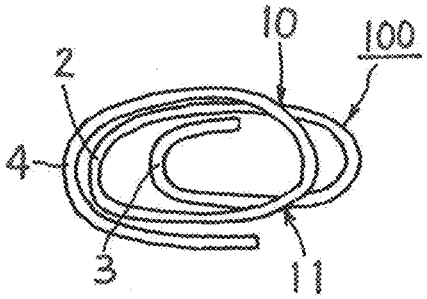
FIG.5
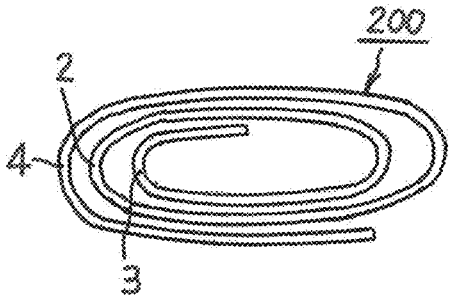
FIG.6
FIG.7A
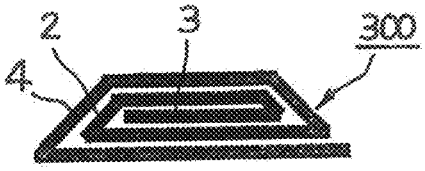
FIG.7B
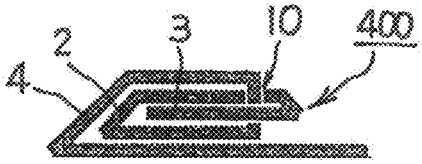
FIG.7C
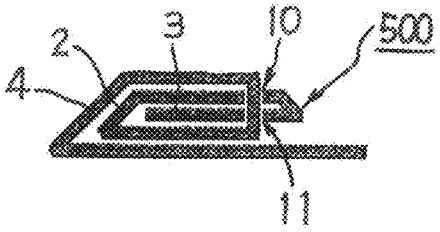

CLIP

RELATED APPLICATIONS

The present application is a National Phase of International Application No. PCT/JP2019/032764 filed Aug. 22, 2019, which claims priority to Japanese Application No. 2018-158417, filed Aug. 27, 2018.

BACKGROUND

Technical Field

This disclosure relates to a clip configured to hold and fasten a folded portion formed by folding a corner of a stack of a plurality of paper pieces.

Background Art

As an example of a clip configured to hold and fasten a plurality of paper pieces together, there has been known a clip called "Gem clip" which is formed by bending a wire to an elongated spiral shape. The Gem clip is inexpensive because of its simple structure. However, the Gem clip has a disadvantage in that the clip itself or some of the paper pieces are liable to move and slip off with a slight external force.

Thus, as a clip without the disadvantage described above, the following clip has been proposed in Japanese Utility Model Publication Laid-open No. S56-163565. The clip has a front-side clamping piece and a back-side clamping piece. The front-side clamping piece is formed continuous with one side of an insertion piece so as to be foldable, and the back-side clamping piece is formed continuous with one side of the front-side clamping piece so as to be foldable. Magnetic attraction members are mounted to the insertion piece and the back-side clamping piece, respectively. With the clip, corners of paper pieces are inserted into the clip so as to be held under a confined state. Thus, the clip is considered to have advantages such as no risk of unexpected movement and slip-off of each paper piece.

With the clip as described in Japanese Utility Model Application Laid-open No. S56-163565, a gripping force for paper pieces is exerted by the magnetic attraction members between the insertion piece and the back-side clamping piece. However, a gripping force for paper pieces is not particularly applied between the insertion piece and the front-side clamping piece or between the front-side clamping piece and the back-side clamping piece. Thus, a gripping force is generally weak, and thus there still arises a problem in that the clip is liable to come off. Further, the clip as described in Japanese Utility Model Publication Laid-open No. S56-163565 is inevitably increased in cost because the insertion piece, the front-side clamping piece, and the back-side clamping piece are formed continuously so as to be foldable. Further, the clip is inevitably increased in cost also because the magnetic attraction members are used.

SUMMARY

This disclosure has been made in view of the circumstances described above, and has an object to provide a clip that is less liable to come off after holding a folded portion formed by folding a corner of a stack of a plurality of paper pieces and is advantageous in terms of cost.

In order to solve the problems described above, according to at least one embodiment of this disclosure, there is provided a clip, including: an insertion piece to be inserted into a valley defined by forming a folded portion formed by folding a corner of a stack of a plurality of paper pieces; a front-side clamping piece to be brought into contact with a paper piece portion on a front side with respect to the valley; and a back-side clamping piece to be brought into contact with a paper piece portion on a back side with respect to the valley, wherein the insertion piece, the front-side clamping piece, and the back-side clamping piece are elastically and integrally formed so that the paper piece portion on the front side and the paper piece portion on the back side with respect to the valley are clamped between the front-side clamping piece and the insertion piece and between the insertion piece and the back-side clamping piece, respectively, and both of the paper piece portion on the front side and the paper piece portion on the back side with respect to the valley are clamped between the front-side clamping piece and the back-side clamping piece.

According to at least another embodiment of this disclosure, the insertion piece, the front-side clamping piece, and the back-side clamping piece are elastically and integrally formed through formation in a spiral shape.

According to at least another embodiment of this disclosure, the clip further includes at least any one of: a first crossing portion configured to allow paper pieces inserted between the back-side clamping piece and the insertion piece to be brought into contact with and pressurized between the back-side clamping piece and the insertion piece; or a second crossing portion configured to allow paper pieces inserted between the front-side clamping piece and the insertion piece to be brought into contact with and pressurized between the front-side clamping piece and the insertion piece.

According to at least another embodiment of this disclosure, the clip further includes a base end portion, wherein the insertion piece, the front-side clamping piece, and the back-side clamping piece are formed as three clip pieces extending from the base end portion.

According to the at least one embodiment of this disclosure, the paper piece portion on the front side and the paper piece portion on the back side with respect to the valley are clamped between the front-side clamping piece and the insertion piece and between the insertion piece and the back-side clamping piece, respectively. At the same time, both of the paper piece portion on the front side and the paper piece portion on the back side are clamped between the front-side clamping piece and the back-side clamping piece. Thus, the clip has a generally strong gripping force, and thus is less liable to come off. Further, the insertion piece is inserted and placed in the valley. Thus, the clip has large resistance against a tensile force acting on the paper pieces. Thus, at the time of manufacture of the clip, use of a low-strength material and reduction in thickness are enabled. Further, because the insertion piece, the front-side clamping piece, and the back-side clamping piece are elastically and integrally formed, the gripping force is generated. Thus, such formation of the clip contributes to reduction in cost. Still further, the clip is attached and removed by using elasticity of the clip. Thus, attachment and removal work is easily performed.

According to the at least another embodiment of this disclosure, the clip is formed with a simple structure, and the simple structure contributes to further reduction in cost.

According to the at least another embodiment of this disclosure, when the paper pieces are inserted, the paper pieces are brought into contact with and pressurized between the insertion piece and the front-side clamping piece or are brought into contact with and pressurized between the insertion piece and the back-side clamping piece at the crossing portion. Thus, the gripping force of the clip is increased. As a result, the clip is much less liable to come off. Further, the increase in gripping force is achieved with a simple structure in which the crossing portion is additionally formed. Thus, the clip is reasonable.

According to the at least another embodiment of this disclosure, the clip has a simple structure, and the simple structure contributes to further reduction in cost.

BRIEF DESCRIPTION OF THE DRAWINGS

FIG. 5 is a plan view for illustrating a modification example of the clip of FIG. 1.

FIG. 6 is a plan view for illustrating a modification example of the clips of FIG. 1 and FIG. 5.

FIG. 7A to FIG. 7C are perspective views of clips according to another embodiment of this disclosure, in which FIG. 7A is a perspective view for illustrating a modification example of the clip of FIG. 6, FIG. 7B is a perspective view for illustrating a modification example of the clip of FIG. 1, and FIG. 7C is a perspective view for illustrating a modification example of the clip of FIG. 5.

DESCRIPTION OF THE EMBODIMENTS

Embodiments of this disclosure are now described with reference to the accompanying drawings.

Figure 1:
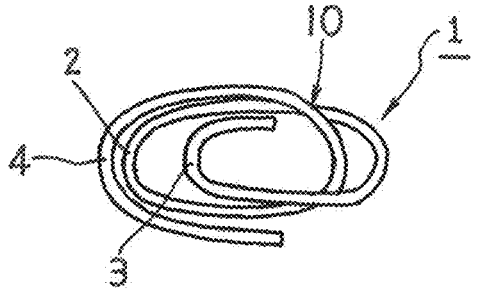
FIG. 1 is a plan view of a clip according to at least one embodiment of this disclosure.
Figure 2:
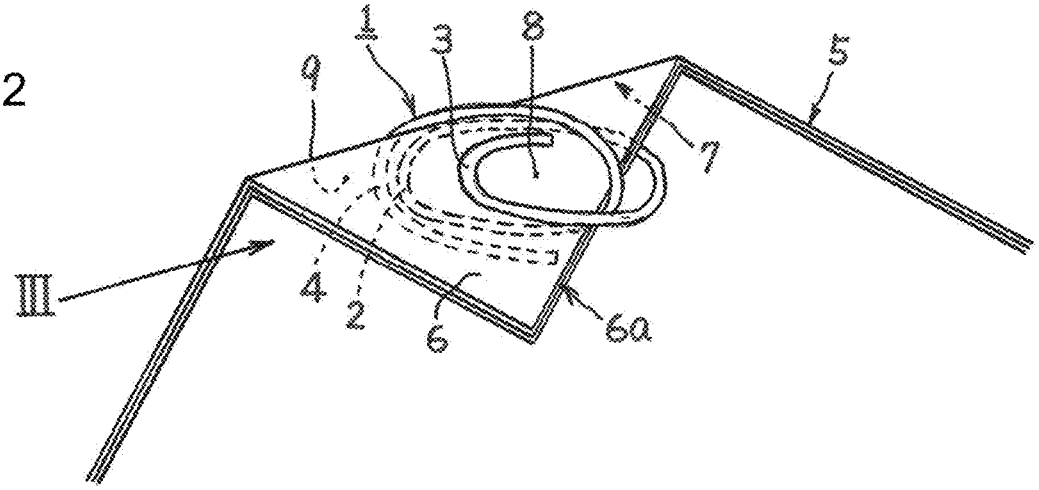
FIG. 2 is a view for illustrating a state of use of the clip of FIG. 1.
Figure 3:
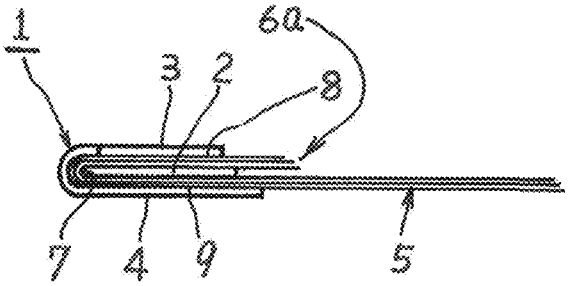
FIG. 3 is a view of the clip under the state of use illustrated in FIG. 2 when viewed in a direction of an arrow III of FIG. 2.

As illustrated in FIG. 1, a clip 1 according to at least one embodiment of this disclosure includes an insertion piece 2, a front-side clamping piece 3, and a back-side clamping piece 4. The insertion piece 2, the front-side clamping piece 3, and the back-side clamping piece 4 are elastically and integrally formed. As illustrated in FIG. 2 and FIG. 3, the insertion piece 2 is inserted into a valley 7 defined by forming a folded portion 6*a*. The folded portion 6*a* is formed by folding a corner 6 of a stack of a plurality of paper pieces 5. Under the inserted state, the front-side clamping piece 3 and the back-side clamping piece 4 are in contact with a paper piece portion 8 on a front side and a paper piece portion 9 on a back side with respect to the valley 7. Owing to elasticity of the clip 1, the paper piece portion 8 on the front side and the paper piece portion 9 on the back side with respect to the valley 7 are clamped between the front-side clamping piece 3 and the insertion piece 2 and between the insertion piece 2 and the back-side clamping piece 4, respectively. At the same time, both of the paper piece portion 8 on the front side and the paper piece portion 9 on the back side with respect to the valley 7 are clamped between the front-side clamping piece 3 and the back-side clamping piece 4.

Figure 4A:
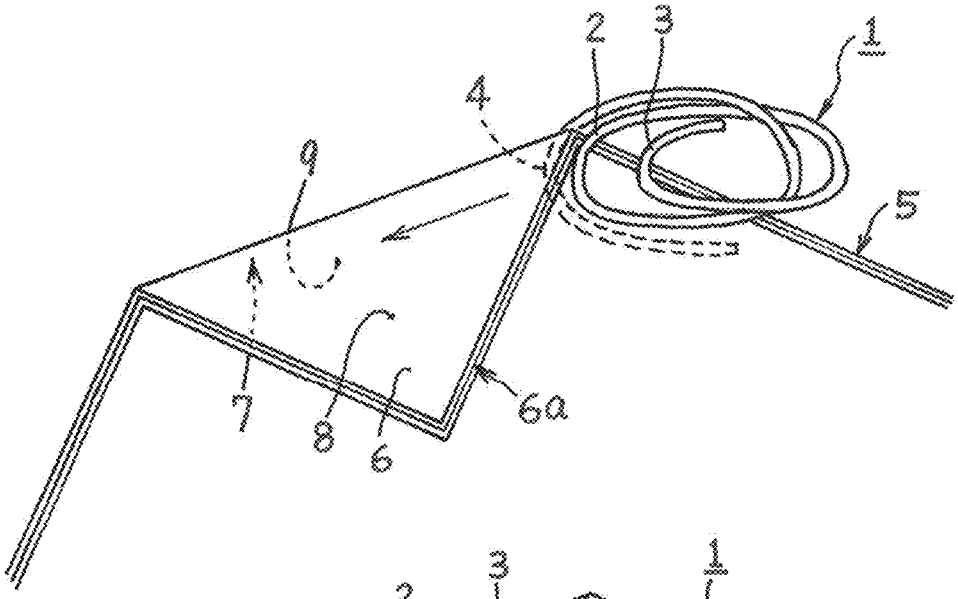
FIG. 4A and FIG. 4B are explanatory views for illustrating a process of fastening a plurality of paper pieces with the clip of FIG. 1.
Figure 4B:
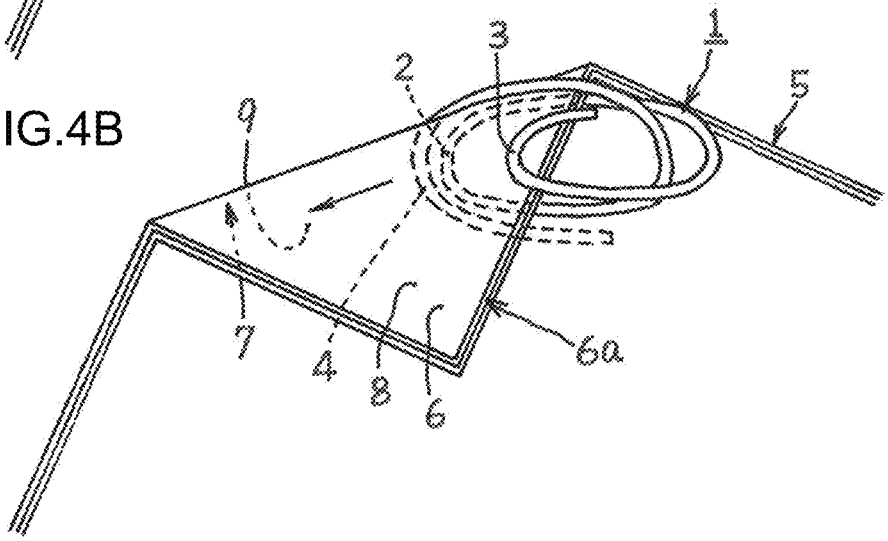

The clip 1 of FIG. 1 is attached to the stack of the plurality of paper pieces 5 in a procedure illustrated in FIG. 4A and FIG. 4B. First, as illustrated in FIG. 4A, the corner 6 of the stack of the plurality of paper pieces 5 is folded to a front side of the stack of the paper pieces 5 to form the folded portion 6*a* having a substantially isosceles triangle shape. Then, as illustrated in FIG. 4A and FIG. 4B, the clip 1 is slid in a direction of an arrow along the valley 7 defined by forming the folded portion 6*a*. At this time, the back-side clamping piece 4 is slid while being in contact with the paper piece portion 9 on the back side with respect to the valley 7 defined by forming the folded portion 6*a*, and the insertion piece 2 is inserted into the valley 7. At the same time, the front-side clamping piece 3 is slid while being in contact with the paper piece portion 8 on the front side with respect to the valley 7. An attachment completion state of the clip 1 is as illustrated in FIG. 2 and FIG. 3. Under a state in which the clip 1 is attached, the insertion piece 2 is located in the deepest portion of the valley 7. When the clip 1 is to be removed, the clip 1 is simply required to be slid in a direction opposite to the sliding direction at the time of attachment.

With the clip 1 of FIG. 1, the paper piece portion 8 on the front side and the paper piece portion 9 on the back side with respect to the valley 7 are clamped between the front-side clamping piece 3 and the insertion piece 2 and between the insertion piece 2 and the back-side clamping piece 4, respectively. In addition, both of the paper piece portion 8 on the front side and the paper piece portion 9 on the back side with respect to the valley 7 are clamped between the front-side clamping piece 3 and the back-side clamping piece 4. Thus, the clip 1 has a generally strong gripping force, and thus is less liable to come off. Further, the insertion piece 2 is inserted and placed in the valley 7. Thus, resistance against a tensile force acting on the paper pieces is large. Accordingly, at the time of manufacture of the clip, use of a low-strength material and reduction in thickness are enabled. Further, because the insertion piece 2, the front-side clamping piece 3, and the back-side clamping piece 4 are elastically and integrally formed, a gripping force is generated. Thus, such formation of the clip 1 contributes to reduction in cost. Still further, the clip 1 is attached and removed by using elasticity of the clip 1. Thus, attachment and removal work is easily performed.

The clip 1 of FIG. 1 is formed in a spiral shape. With this shape, the insertion piece 2, the front-side clamping piece 3, and the back-side clamping piece 4 are elastically and integrally formed. The formation of the clip 1 with a simple structure contributes to further reduction in cost. When the clip 1 is formed to have a narrower overall shape, a folding allowance, that is, the folded portion 6*a* can be reduced in size.

As illustrated in FIG. 1, it is preferred that the clip have a first crossing portion 10. When paper pieces are inserted between the back-side clamping piece 4 and the insertion piece 2, the paper pieces are brought into contact with and pressurized between the back-side clamping piece 4 and the insertion piece 2 at the first crossing portion 10. Further, as in a case of a clip 100 illustrated in FIG. 5, it is preferred that the clip have a second crossing portion 11 in addition to the first crossing portion 10 similar to that illustrated in FIG. 1. When paper pieces are inserted between the front-side clamping piece 3 and the insertion piece 2, the paper pieces are brought into contact with and pressurized between the front-side clamping piece 3 and the insertion piece 2 at the second crossing portion 11. With at least any one of the crossing portions 10 and 11, when paper pieces are inserted, the paper pieces are brought into contact with and pressurized between the back-side clamping piece 4 or the front-side clamping piece 3 and the insertion piece 2 at the crossing portion 10, 11. Thus, the gripping force of the clip 1, 100 is increased. Thus, the clip is much less liable to come off. Further, an increase in gripping force is achieved with a simple structure in which the crossing portion 10, 11 is additionally formed. Thus, the clips 1 and 100 are reasonable.

As illustrated in FIG. 6, as a matter of course, a clip 200 may have a spiral shape without any crossing portion. In this case, the clip 200 has a simpler structure. Thus, the clip is more easily manufactured, and cost can be reduced. In terms of the gripping force, however, the examples illustrated in FIG. 1 and FIG. 5 are superior.

The clip 1 of FIG. 1, the clip 100 of FIG. 5, and the clip 200 of FIG. 6, each having a spiral shape, can be manufactured by bending one metal wire material having elasticity with a circular sectional shape into a spiral shape. As the metal wire material, it is particularly preferred that a wire material made of stainless steel be used. With the manufacturing method, the clip can easily be manufactured. Thus, the manufacturing method contributes to reduction in cost. As another manufacturing method, a suitable molding method such as injection molding can also be employed. In this case, besides a metal, materials such as plastic and paper can be used as a molding material of the clips 1, 100, and 200. In a case of the molding using paper, for example, a molding material obtained by mixing a water-soluble binder and water with raw-material pulp may be used. When the clip is manufactured with paper, the clip can be shredded together with a document. Because of easy disposal, the clip manufactured with paper is preferred.

As examples of clips having other shapes, clips illustrated in FIG. 7A to FIG. 7C are given. As illustrated in FIG. 7A, a clip 300 has angularly bent portions. FIG. 7A corresponds to a modification example of the clip 200 of FIG. 6, and is an illustration of the clip 300 as an example without a crossing portion. The clip 300 of FIG. 7A can be manufactured by punching a sheet material made of a metal, plastic, or paper, each having elasticity. Further, a clip 400 of FIG. 7B corresponds to a modification example of the clip 1 of FIG. 1. In the clip 400, the first crossing portion 10 is formed. A clip 500 of FIG. 7C corresponds to a modification example of the clip 100 of FIG. 5. In the clip 500, the first crossing portion 10 and the second crossing portion 11 are formed. The clip 300 of FIG. 7A, the clip 400 of FIG. 7B, and the clip 500 of FIG. 7C can also be manufactured with, for example, a metal, plastic, or paper as a molding material by an appropriate molding method using a mold, such as injection molding. Further, the clip can also be manufactured by connecting a plurality of elongated wire materials or sheet materials by a method such as bonding, fusion, or welding.

Next, clips according to another embodiment of this disclosure are described with reference to FIG. 8 to FIG. 12.

Figure 8:
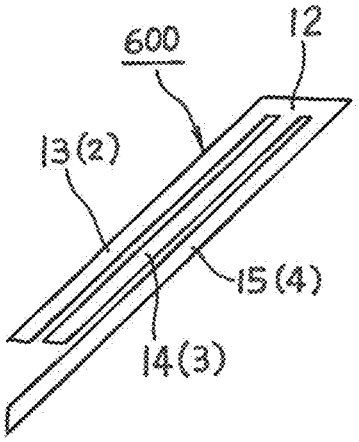
FIG. 8 is a plan view of a clip according to at least another embodiment of this disclosure.

A clip 600 of FIG. 8 has a base end portion 12 and three clip pieces 13, 14, and 15. The three clip pieces 13, 14, and 15 extend from the base end portion 12. The three clip pieces 13, 14, and 15 form the insertion piece 2, the front-side clamping piece 3, and the back-side clamping piece 4, respectively. Actions of the insertion piece 2, the front-side clamping piece 3, and the back-side clamping piece 4 are the same as those of the insertion piece 2, the front-side clamping piece 3, and the back-side clamping piece 4 of FIG. 1. The clip 600 of FIG. 8 has the same actions and effects as those of the clip 1 of FIG. 1.

The clip 600 of FIG. 8 has a simple structure, and the simple structure contributes to further reduction in cost. As in the cases of the clips described above, the clip 600 of FIG. 8 can be manufactured with, for example, a metal, plastic, or paper by punching or a suitable molding method.

Figure 9:
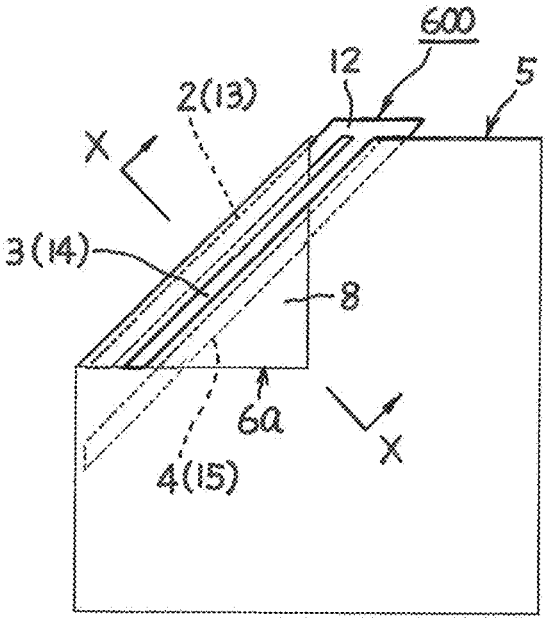
FIG. 9 is a view for illustrating a state of use of the clip of FIG. 8.
Figure 10:
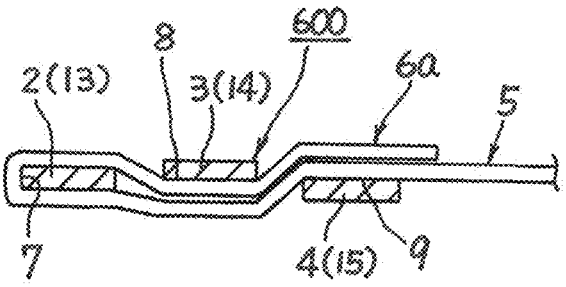
FIG. 10 is an enlarged end view taken along the line X-X of FIG. 9 when viewed in a direction of arrows.

In the clip 600 of FIG. 8, the three clip pieces 13, 14, and 15 are arranged in the order of the insertion piece 2, the front-side clamping piece 3, and the back-side clamping piece 4 from a bottom side of the valley 7 defined by forming the folded portion 6*a*, under a state of use illustrated in FIG. 9 and FIG. 10. The back-side clamping piece 4 is formed so as to be the longest of the three clip pieces. As the at least another embodiment of this disclosure, the positions of the front-side clamping piece 3 and the back-side clamping piece 4 may be switched. When the three clip pieces 13, 14, and 15 are formed to have larger distances therebetween, the number of paper pieces that can be held by the clip can be increased.

Figure 11:
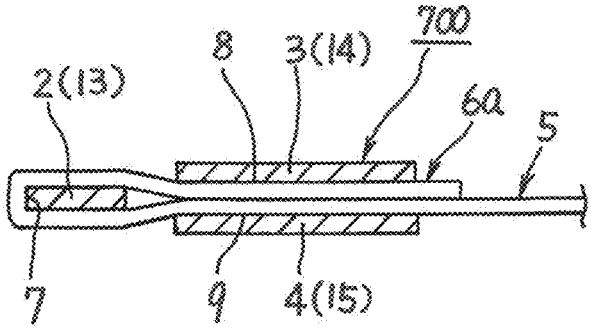
FIG. 11 is a sectional view for illustrating a modification example of the clip of FIG. 10.

As another example of the clip of FIG. 10, a clip 700 illustrated in FIG. 11 may be used. The clip 700 illustrated in FIG. 11 corresponds to a modification example of the clip of FIG. 10. In the clip 700, positions of the front-side clamping piece 3 and the back-side clamping piece 4 with respect to the insertion piece 2 are changed. The front-side clamping piece 3 and the back-side clamping piece 4 are arranged so as to vertically overlap with each other. The insertion piece 2 is located just beside the two clamping pieces 3 and 4. Under a state of use illustrated in FIG. 11, the insertion piece 2 is inserted to the deepest portion of the valley 7 defined by forming the folded portion 6*a*. The front-side clamping piece 3 and the back-side clamping piece 4 are brought into pressure contact with the paper piece portion 8 on the front side and the paper piece portion 9 on the back side with respect to the valley 7, respectively. An increased or decreased number of paper pieces can be dealt with by providing clips having various widths of gaps between the insertion piece 2 and each of the clamping pieces 3 and 4 and between the clamping pieces 3 and 4.

Figure 12:
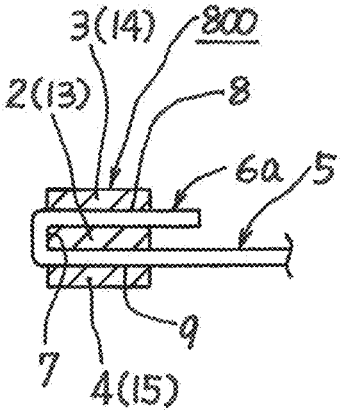
FIG. 12 is a sectional view for illustrating a modification example of the clip of FIG. 9 and FIG. 10.

As in a case of a clip 800 of FIG. 12, the folded portion 6*a* of the stack of the plurality of pieces 5 may be clamped between the front-side clamping piece 3, and the insertion piece 2 and the back-side clamping piece 4, which are located at positions vertically overlapping with each other. With this structure, the folded portion 6*a* can be reduced in size as much as possible. Thus, when pages of the clipped paper pieces 5 are turned over, the clip 800 is less liable to become an obstacle, and thus is preferred.

The clip according to the at least one embodiment of this disclosure is less liable to allow the paper pieces to slip off when pages are turned over in comparison to related-art Gem clips. Further, the clip according to the at least another embodiment of this disclosure does not have a thickness as large as related-art double clips or bulldog clips, and thus is easily attached and removed. Further, the paper pieces are held so as not to slip off not only with the gripping force generated owing to elasticity but also through the contact of the insertion piece 2 with the deepest portion of the valley 7 defined by forming the folded portion 6*a* of the stack of the paper pieces. Thus, use of a low-strength material and reduction in thickness are enabled. Thus, for example, a clip made of natural cellulose such as fiber paper or nanocellulose fiber paper as a raw material, which has a reduced environmental load, can be provided.

What is claimed is:

1. A clip, comprising:

an insertion piece to be inserted into a valley defined by forming a folded portion formed by folding a corner of a stack of a plurality of paper pieces;

a front-side clamping piece to be brought into contact with a paper piece portion on a front side with respect to the valley; and a back-side clamping piece to be brought into contact with a paper piece portion on a back side with respect to the valley, wherein the insertion piece, the front-side clamping piece, and the back-side clamping piece are elastically and integrally formed so that the paper piece portion on the front side and the paper piece portion on the back side with respect to the valley are clamped between the front-side clamping piece and the insertion piece and between the insertion piece and the back-side clamping piece, respectively, and both of the paper piece portion on the front side and the paper piece portion on the back side with respect to the valley are clamped between the front-side clamping piece and the back-side clamping piece, the clip further comprises at least one of a first crossing portion between the back-side clamping piece and the insertion piece, or a second crossing portion between the front-side clamping piece and the insertion piece, and the insertion piece, the front-side clamping piece, and the back-side clamping piece are elastically and integrally formed through formation in a spiral shape.

2. A clip, comprising:

an insertion piece to be inserted into a valley defined by forming a folded portion formed by folding a corner of a stack of a plurality of paper pieces;

a front-side clamping piece to be brought into contact with a paper piece portion on a front side with respect to the valley; and a back-side clamping piece to be brought into contact with a paper piece portion on a back side with respect to the valley, wherein the insertion piece, the front-side clamping piece, and the back-side clamping piece are elastically and integrally formed so that the paper piece portion on the front side and the paper piece portion on the back side with respect to the valley are clamped between the front-side clamping piece and the insertion piece and between the insertion piece and the back-side clamping piece, respectively, and both of the paper piece portion on the front side and the paper piece portion on the back side with respect to the valley are clamped between the front-side clamping piece and the back-side clamping piece, the insertion piece, the front-side clamping piece, and the back-side clamping piece are elastically and integrally formed through formation in a spiral shape, and the clip further comprises at least any one of:

a first crossing portion configured to allow paper pieces inserted between the back-side clamping piece and the insertion piece to be brought into contact with and pressurized between the back-side clamping piece and the insertion piece; or a second crossing portion configured to allow paper pieces inserted between the front-side clamping piece and the insertion piece to be brought into contact with and pressurized between the front-side clamping piece and the insertion piece.

* * * * *